United States Patent [19]

Fujie et al.

[11] 4,166,498

[45] Sep. 4, 1979

[54] VAPOR-CONDENSING, HEAT-TRANSFER WALL

[75] Inventors: Kunio Fujie, Tokyo; Wataru Nakayama, Kashiwa; Takahiro Daikoku, Ibaraki; Shigeki Hirasawa, Noda; Kimio Kakizaki, Hitachi, all of Japan

[73] Assignees: Hitachi, Ltd.; Hitachi Cable, Ltd., both of Japan

[21] Appl. No.: 815,028

[22] Filed: Jul. 12, 1977

[30] Foreign Application Priority Data

Jul. 13, 1976 [JP] Japan ..... 51-82575

[51] Int. Cl.[2] ..... F28B 9/08; F28F 3/04; F28F 13/18

[52] U.S. Cl. ..... 165/133; 165/110; 165/181

[58] Field of Search ..... 165/110, 111, 133, 179, 165/181, 184; 62/285, 288, 290

[56] References Cited

U.S. PATENT DOCUMENTS

| | | | |
|---|---|---|---|
| 3,217,799 | 11/1965 | Rodgers | 165/179 |
| 3,487,670 | 1/1970 | Ware | 165/133 |
| 3,496,752 | 2/1970 | Kun et al. | 165/133 |
| 3,768,290 | 10/1973 | Zatell | 165/133 |
| 3,866,286 | 2/1975 | Pasternak | 165/181 |
| 3,906,604 | 9/1975 | Kakizaki et al. | 165/133 |
| 4,040,479 | 8/1977 | Campbell et al. | 165/133 |
| 4,059,147 | 11/1977 | Thorne | 165/133 |

FOREIGN PATENT DOCUMENTS

| | | | |
|---|---|---|---|
| 1305667 | 2/1973 | United Kingdom | 165/181 |

*Primary Examiner*—Sheldon Jay Richter
*Attorney, Agent, or Firm*—Craig and Antonelli

[57] ABSTRACT

A condensing, a heat-transfer wall for liquefying vapor having a temperature higher than the wall by bringing the vapor in contact therewith. There are provided many parallel grooves in the basic surface of the heat-transfer wall, thereby defining ridge portions or build-up portions thereamong. These ridge portions have their tip portions tapered at sharp acute angle. Recessed or concave portions are provided in the tip portions of these ridge portions, and these recessed portions have their surfaces inclined to the basic surface of the heat-transfer wall. The width of the respective grooves ranges from 0.05 to 2.5 mm, and the depth thereof is not more than 10 mm. The thickness of the respective ridge portions ranges from 0.01 to 2.5 mm, and the height there of is not more than 10 mm. The depth of the recessed portions ranges from 0.02 to 0.8 times the depth of the grooves, and the pitch of recessed portion is not more than 2.0 mm. The width of the tip portions of the portions is 0.01 to 1.0 times the pitch of the recessed portions.

3 Claims, 6 Drawing Figures

VAPOR-CONDENSING, HEAT-TRANSFER WALL

This invention relates to a vapor-condensing, heat-transfer wall for liquefying vapor of a temperature higher than the wall by bringing the vapor in contact with the wall, such as heat transfer tubes in a condenser for use in a turbo-refrigerator, air conditioner, and the like, or heat-transfer walls in a liquefying unit for use in an air-separating device.

As used in condensers in turbo-refrigerators and air conditioners, the vapor-condensing, heat-transfer walls find a wide application in liquefying vapor of a temperature higher than the walls by bringing the vapor in contact therewith. The heat-transfer surfaces as used in the aforesaid condensors are flat surfaces or so conventional called low-fin surfaces having fins of a relatively low height on the flat surfaces, as for example, the low-fin surfaces in U.S. Pat. Nos. 3,180,405 and 3,893,322.

In case high-temperature vapor is liquefied on the flat surface by bringing the former in contact with the latter, the vapor is first liquefied into droplets which cling to a heat-transfer surface, and as the liquefaction proceeds, the heat-transfer surface is covered with a liquid film of a large thickness. This liquid film serves as thermal resistance, thereby lowering heat-transfer rate.

The low-fin surfaces are devoid of the possibility of a thick liquid film being formed on the heat transfer surface. However, this provides insufficient heat transfer rate, so that difficulties are encountered in reducing the size or in improving the performances of the condensers or refrigerators using the heat-transfer tubes or heat-transfer walls of a low fin surface type.

It is an object of the present invention to provide a condenser, turbo-refrigerator, air conditioner, and air separator, which are of high performance and of a compact size by providing a vapor-condensing, heat-transfer wall of a high heat transfer rate.

According to the present invention, there is provided a vapor-condensing, heat-transfer wall, in which a plurality of parallel grooves are provided in the basic surface of a heat transfer wall in a manner that a plurality of ridge portions or build-up portions having their tip portions tapered at a sharp acute angle, and concave or recessed portions are provided in the tip portions of the aforesaid ridge portions with the surfaces of the recessed portions being inclined to the basic surface of the wall; the width of the respective grooves being in a range from 0.05 to 2.5 mm, the depth thereof being not more than 10 mm; the thickness of the respective ridge portions being in a range from 0.01 to 2.5 mm, the height thereof being not more than 10 mm; the depth of the respective recessed portions being 0.02 to 0.8 times the depth of the grooves, the spacing or pitch of the recessed portions being not more than 0.2 mm; and the width of the tip portions of the ridge portions being 0.01 to 1.0 times the pitch of the recessed portions.

FIG. 1 is a perspective view illustrative of the vapor-condensing, heat transfer wall according to the invention in an enlarged scale.

Figure 1:
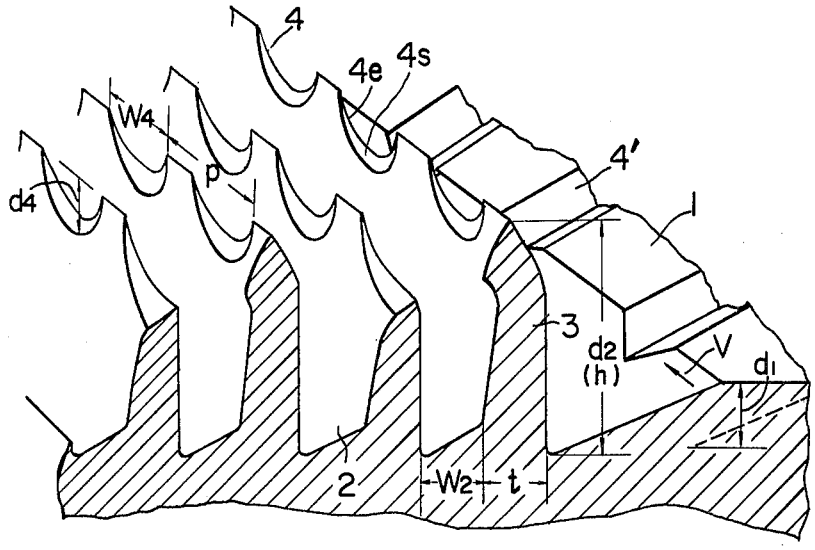
FIG. 1 is an enlarged, perspective view of a vapor-condensing, heat transfer wall according to the present invention.

The heat transfer wall according to the invention includes: a plurality of parallel grooves 2 which are provided in a basic surface 1 of the heat transfer wall; a plurality of ridge portions 3 defined by the grooves 2 thereamong, the aforesaid ridge portions 3 having their tip portions tapered at a sharp acute angle; and recessed portions 4 whose surfaces 4S are inclined to the basic surface 1, and whose edges 4e tapered at an acute angle. The width $W_2$ of the respective grooves 2 ranges from 0.05 to 2.5 mm, the depth $d_2$ thereof is not more than 10 mm; the thickness t of the respective ridge portions 3 ranges from 0.01 to 2.5 mm, the height thereof is not more than 10 mm; the pitch p of the recessed portions 4 is not more than 2.0 mm; the width $w_4$ of the tip ends of ridge portions ranges from 0.01 to 1.0 times the pitch p of the recessed portions, and the depth $d_4$ of the recessed portions is 0.01 to 0.8 times the depth $d_2$ of the grooves 2.

In case the density of grooves 2 formed in the basic surface 1 of the heat-transfer wall is increased, then the density of ridge portions is increased accordingly, so that vapor-condensing portions are increased in number, and hence the heat transfer performance of the wall is improved, while an increase in density of grooves leads to a decrease in width $w_2$ of the grooves 2, as well as to decrease in thickness of ridge portions 3. If a decrease in width $w_2$ and thickness t is excessive, then the heat transfer performance of the wall is lowered conversely. This is because if the width $w_2$ of grooves 2 is decreased, then condensed liquid dwelling in grooves 2 is increased relatively so that the effective surface area of ridge portions is decreased. In case the thickness t of the ridge portion 3 is decreased, then thermal resistance of the root portions of the ridge portions 3 increase, so that the tip portions of the ridge portions 3 are not maintained effectively cooled for condensation of vapor, despite the face the condensation should most vigorously take place in the tip portions of the ridge portions 3.

The relationships between the aforesaid two factors and the heat transfer performance of the wall are subject to limits or peaks, respectively. The peaks appear when the width $w_2$ of grooves 2 is about 0.4 mm and a thickness t of the ridge portions is about 0.2 mm. These factors have their maximum values, respectively. However, as far as the these factors fall in certain ranges, then the performance over a given level may be expected. That is, these ranges are such that the width $w_2$ of the grooves 2 is from 0.05 to 2.5 mm and the thickness t of the ridge portions 3 is from 0.01 to 2.5 mm. More preferably, the width $w_2$ of grooves 2 ranges from 0.15 to 1.2 mm and the thickness t of the ridge portions 3 ranges from about 0.01 to 1.25 mm.

As far as the width $w_2$ of grooves 2 and thickness t of the ridge portions 3 fall in the above ranges, the variations in the depth $d_2$ of grooves 2 or height h of the ridge portions 3 exert little effect on the heat transfer performance of the wall. This is because in case the depth $d_2$ of the grooves 2 or the height h of the ridge portions 3 is increased, then the surface area of the ridge portions 3 is increased accordingly, while the tip portions, which is most effective for condensation, of the ridge portions 3 are maintained less cooled through the medium of root portions thereof, so that the condensing performance of the tip portions of the ridge portions is lowered or impaired.

Meanwhile, the ridge portions are formed by cutting or plowing the basic surface of the wall at an angle and then the inclined ridge portions thus formed are raised at the right angle to the basic surface, with the result that the depth $d_2$ of the grooves 2, i.e., the height h of the ridge portions 3 are subjected to limitations arising from the cutting or plowing operation. The depth $d_2$ or the height h thereof should be less than about 10 mm, in case the heat transfer wall is made of a metal such as copper or aluminum. In short, the depth $d_2$ or the height h should be such as not to be filled with condensed liquid, completely.

While the heat transfer wall is equipped with the grooves 2 and ridge portions 3 having the aforesaid dimensions, the ridge portions 3 are further provided with concave or recessed portions 4 in their tip portions at a given spacing or pitch, so that vapor-condensing portions are increased in number, with the resulting enhancement in heat transfer performance of the wall. However, the heat transfer performance of the wall exhibits an increasing tendency at such pitches of the recessed portions 4 as ranging from 0.25 to 2.0 mm, as will be described hereinafter. In case the pitch of the recessed portions 4 exceeds 2.0 mm, then the heat transfer performance is lowered. The preferable range of the pitch of the recessed portions is between 0.25 and 1.0 mm. Meanwhile, even in a case where the pitch of the recessed portions 4 is made to have a constant preferable value in the range, if the areas of recessed portions 4 is increased, then the remaining materials in the tip portions of the ridge portions 3 are decreased in mass, so that the vapor-condensing performance of the wall is lowered. On the other hand, in case the width $W_4$ of the recessed portions 4 formed in the tip portions of the ridge portions 3 are excessively reduced, then the recessed portions 4 tend to be filled with condensed liquid, so that the effect of the recessed portions 4 is neutralized, or lost. This signifies that the heat transfer rate of the wall is governed by the width $W_4$ of the recessed portions provided in the tip portions of the ridge portions 3.

Excellent heat transfer performance may be achieved in case that the pitch p of the recessed portions 4 is not more than 2 mm, and the width $W_4$ of the recessed portions 4 ranges from 0.01 to 1.0. Preferably, the width $W_4$ of the recessed portions 4 should be 0.3p.

The heat transfer wall having the aforesaid grooves 2, ridge portions 3 and recessed portions 4 may be formed on the surface of a plate, a board or a pipe made of copper or aluminum by using press-forming technique in combination with a cutting or plowing operation without cutting off the surface thereof. Firstly, the basic surface of the heat transfer wall is formed to have a plurality of parallel first grooves 4' of a 'V' shape by pressing a knurling tool against the basic surface. In this respect, the first grooves 4' will become the recessed portions 4 to be formed in the tip portions of the ridge portions in the heat transfer wall of an end product. Then, a plowing cutter is fed to the wall in the direction to cross the first grooves 4' (preferably at an angle of 45° or 135° to the first grooves 4', thereby forming second inclined grooves having a depth greater than that of the first grooves 4', after which the wall of inclined second grooves is raised at a right angle to the basic surface of the wall. Thus, the grooves 2 and ridge portions 3 are formed. Shown by a broken line in FIG. 1 is a position of a plowing cutter when the cutter is about to raise the wall of inclined second groove. In this manner, a wall of the inclined second groove having a depth greater than the depth of the first grooves 4' is raised at a right angle to the basic surface of the wall by means of a plowing cutter, so that there may be formed ridge portions 3 having a height which is greater in dimension than the cutting depth $d_1$ of a plowing cutter, and the tip portions of respective ridge portions 3 may be tapered at an acute angle, with one side of the surfaces of the tip portions of the ridge portions being transferred from a part of the basic surface of the wall. In addition, when the wall of a second groove is raised, the first grooves 4' are deformed in a tool-advancing direction v, so that at the same time the side edges 4*e* of the second groove being made to have a sharp acute angle.

The sharp tip portions of ridge portions 3 and sharp side edges 4*e* of the recessed portions 4 aid not only in forming thin films of condensed liquid clinging to the ridge portions 3 but also in dividing the liquid films into pieces, thereby exposing effective condensing surfaces and allowing rapid introduction of condensed liquid into grooves 2.

Figure 2:
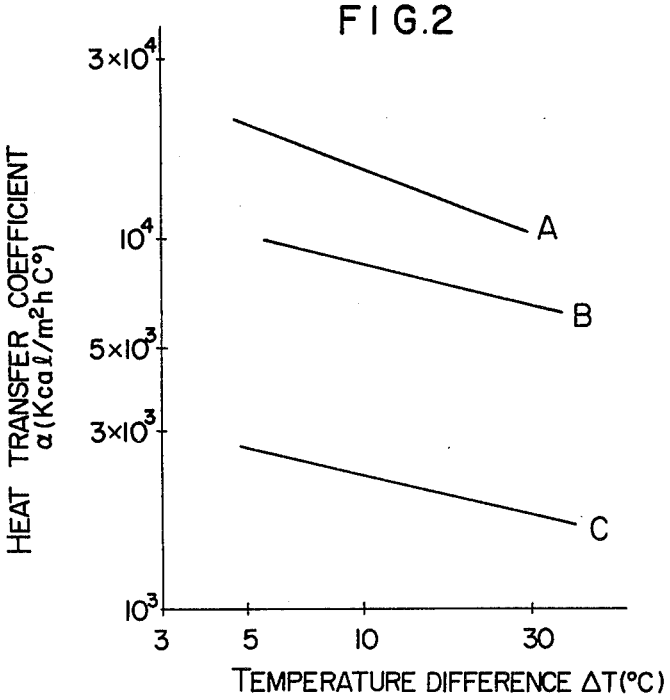
FIG. 2 is a plot showing comparison in heat transfer coefficient between the heat transfer wall according to the present invention and the heat transfer wall according to the prior art.

FIG. 2 is a plot comparing the performances of the heat transfer wall according to the present invention with the prior art flat surface and the low-fin surface. In this respect, a square heat transfer wall of 50×50 mm was placed in the vertical direction, with the longitudinal direction of the grooves 2 being maintained also in the vertical direction for testing the condensing performances of the wall. The heat transfer wall is made of copper, while a cooling medium was trichloroethane (R-113). In FIG. 2, the abscissa represents temperature difference ΔT (°C.) between the vapor and the heat transfer wall, while the ordinate represents heat transfer coefficient α (kcal/m²·h·C°). The characteristic curve A represents the performance of the heat transfer wall according to the present invention. In this case, the width $W_2$ of the grooves 2 to 0.35 mm (average of widths of each grooves 2), the depth $d_2$ of the grooves 2 or the height h of the ridge portions 3 is 0.9 mm, the thickness t of the ridge portions 3 is 0.35 mm (average of the thickness of each ridge portion 3), the pitch p of the recessed portions 4 is 0.5 mm, the depth $d_4$ of the recessed portions 4 is 0.2 mm, and the width $W_4$ of the recessed portions 4 (average of the widths of each recessed portion 4) is 0.2 mm. The characteristic curve B represents the performance of the low fin surface, wherein the pitch of the fins is 1.4 mm, and the height of fins is 1.3 mm. The characteristic curve C represents the performance of the flat surfaces. As can be seen from FIG. 2, the heat transfer wall according to the present invention provides a heat transfer performance A about two times as high as that of the low-fin surface, and about 7 times as high as that of the flat surface, thus presenting excellence in performance.

Figure 3:
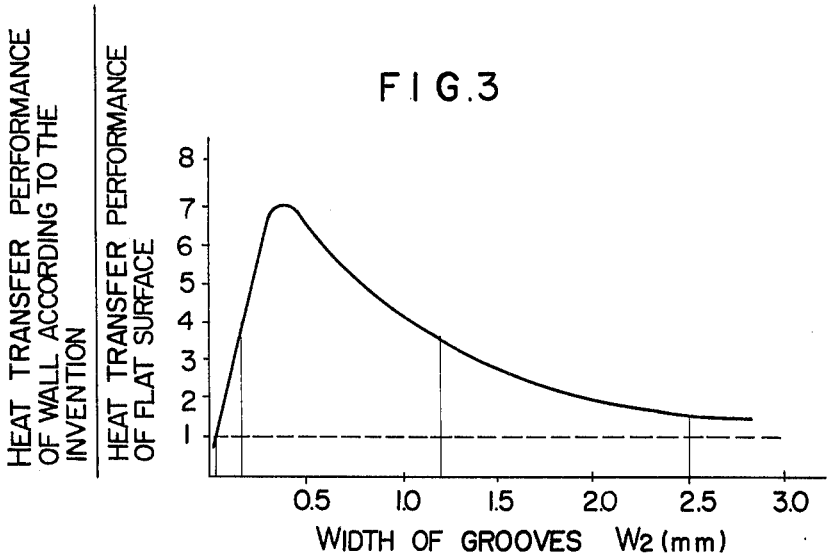
FIG. 3 is a plot showing the effect of widths of grooves on the heat-transfer performance.
Figure 4:
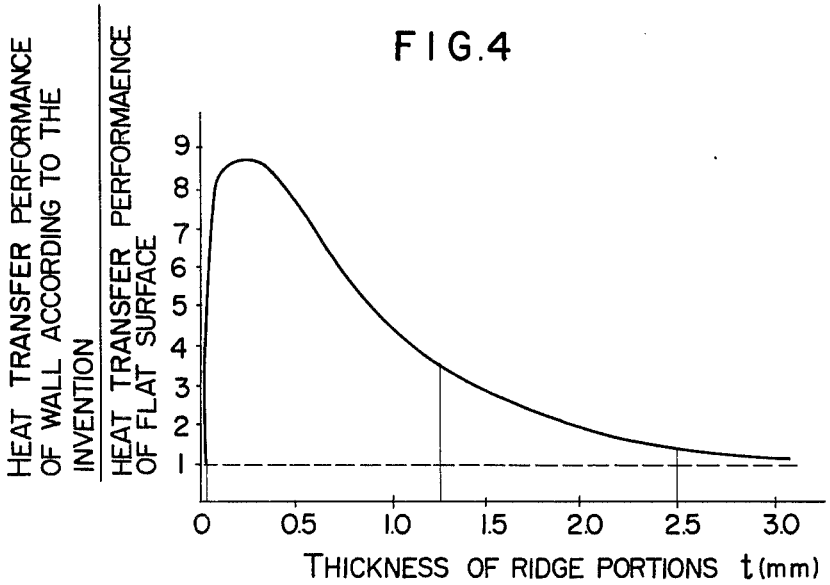
FIG. 4 is a plot showing the effect of thickness of a ridge portion on the heat trasfer performance.

FIG. 3 shows a plot illustrative of the effect of a variation in width $W_2$ of the grooves 2 on the heat transfer performance of a heat transfer wall according to the present invention, in case the thickness t of the ridge portions 3 is 0.35 mm (average of the thickness of each ridge portion 3). The test condition in this case is the same as that in the case of FIG. 2. In FIG. 3, the abscissa represents the width $W_2$ of grooves 2, (average of width of each groove) while the ordinate represents a ratio of heat transfer performance of the heat transfer wall according to the invention to that of the flat surface. As can be seen from FIG. 3, desired performance was achieved at the width $W_2$ of 0.05 to 2.5 mm. In case the width $W_2$ ranges from 0.15 to 1.2 mm, then better performance was achieved than that of the low-fin surface. FIG. 4 shows a plot illustrative of the effect of a variation in the thickness t of the ridge portions 3 on the heat transfer performance of the wall, in which the width $W_2$ of the grooves 2 is maintained at 0.35 mm (average of width of each groove 2). The test condition in this case is the same as that of FIG. 2. In FIG. 4, the abscissa represents the thickness t of the ridge portions 3 (average thickness of each ridge portion 3), while the ordinate represents a ratio of the heat transfer performance of the heat transfer wall according to the present invention to that of the flat surface.

A can be seen from FIG. 4, good performance was achieved at the thickness t of 0.01 to 2.5 mm, while better performance was achieved than that of the low-fin surface at thickness t of about 0.01 to 1.25 mm.

Figure 5:
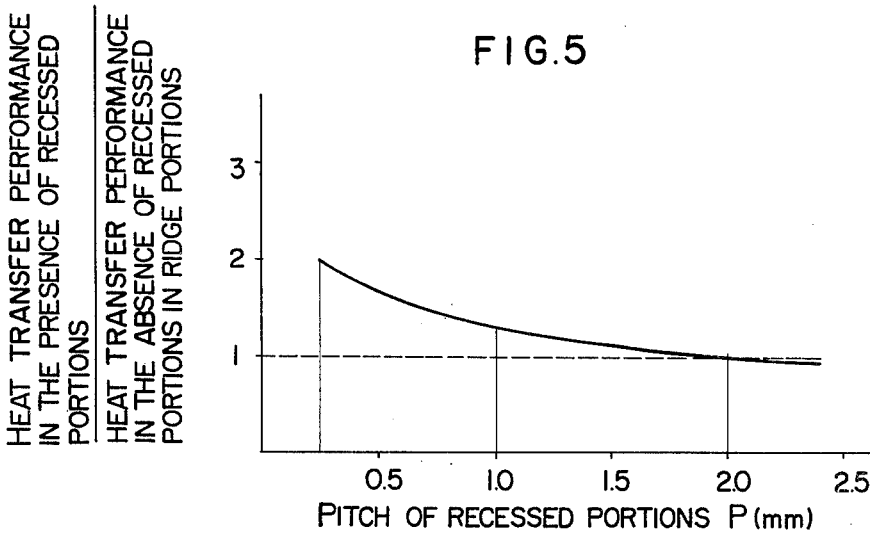
FIG. 5 is a plot showing the effect of pitch of the recessed portions on the heat transfer performance.

FIG. 5 shows a plot illustrative of the effect of the pitch p of the recessed portions 4 on the heat transfer performance of the walls. In the heat conductive wall in this case, the width $W_2$ of the groove 2 is 0.35 mm (average of width of each groove), the depth $d_2$ of grooves 2 is 1 mm. In addition, the grooves 2 are provided in a spiral form in the outer periphery of a copper tube of an outer diameter of 16 mm, the thickness t of the ridge portions 3 is 0.35 mm (average thickness of each ridge portion 3), the depth $d_4$ of the recessed portions 4 is 0.2 to 0.4 mm, and the width $W_4$ of the recessed portions 4 is 0.2 to 0.4 mm. Furthermore, the cooling medium used is dichlorodifluoromethane (R-12). Excellent performance was obtained, in case the pitch p of the recessed portions 4 is less than 2.0 mm. Meanwhile, in FIG. 5, the abscissa represents the pitch p of the recessed portions 4, while the ordinate represents a ratio of the performance of the case wherein the recessed portions are provided, to that of the case wherein the recessed portions are not provided.

Figure 6:
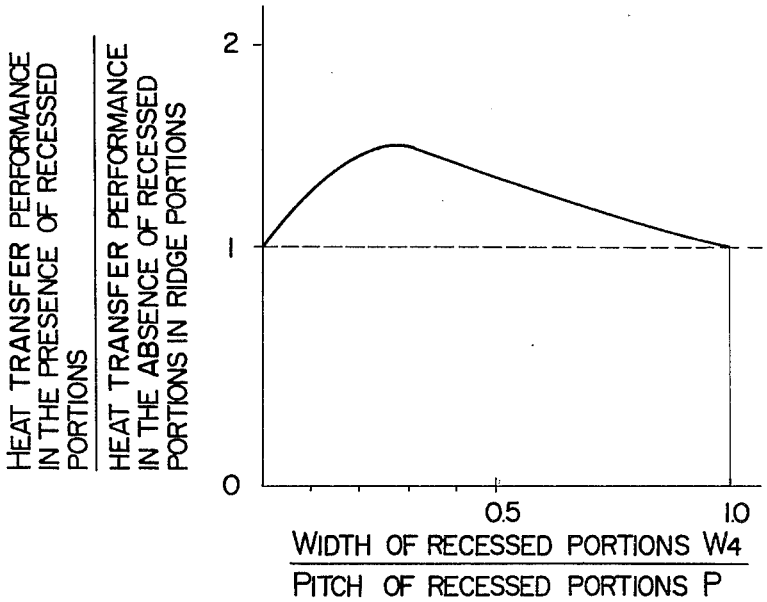
FIG. 6 is a plot showing the effect of width of the recessed portions on the heat transfer performance.

FIG. 6 is a plot illustrative of the effect of a ratio in area of the recessed portions i.e., the width $W_4$ thereof on the heat transfer performance. The heat transfer wall used in this case was the same as used in FIG. 5, except for the width $W_4$ of the recessed portions 4. The cooling medium is the same as that of the case of FIG. 5.

in FIG. 6, the abscissa represents a ratio of the width $W_4$ to the pitch p of the recessed portions 4 thereof, while the coordinate represents a ratio of the performance of the case wherein recessed portions 4 are provided in the ridge portions 3, to that of the case wherein the recessed portions 4 are absent.

As can be seen from FIG. 6, good heat transfer performance may be achieved at widths $W_4$ of the recessed portions 4, of 0.01 p to 1.0 p.

What is claimed is:

1. A vapor-condensing, heat transfer wall which liquefies vapor of a higher temperature than said wall by bringing the vapor into contact with said wall, comprising:

a plurality of parallel grooves provided in the basic surface of said wall;

a plurality of parallel ridge portions defined by said grooves thereamong, said portions having tip portions tapered in an acute angle and said portions extending perpendicularly to the basic surface of said wall; and recessed portions provided in the tip portions of said ridge portions, the bottom surfaces of said recessed portions being inclined to said basic surface, and the edge surfaces of said recessed portions being tapered at a sharp angle;

the width of said grooves being 0.05 to 2.5 mm., the thickness of said ridge portions being 0.01 to 2.5 mm, the height thereof being not more than 10 mm; the depth of said recessed portions being 0.02 to 0.8 times the depth of said grooves, said depth of said recessed portions being measured from the tip of said ridge portions, the pitch of said recessed portions not more than 2.0 mm, said pitch being measured in the longitudinal direction of said ridge portions, and the width of said recessed portions provided in the tip portion of said ridge portions in the longitudinal direction of the ridge portions being 0.01 to 1.0 times the pitch of said recessed portions; the recessed portions each extending at an angle of about 45°, in a crossing direction, with respect to the orientation of said ridge portions.

2. A vapor-condensing, heat transfer wall as set forth in claim 1, wherein the width of said grooves is 0.15 to 1.2 mm, the depth of said grooves is not more than 10 mm, the thickness of said ridge portions is 0.01 to 1.25 mm, the height of said ridge portions is not more than 10 mm, the depth of said recessed portions is 0.02 to 0.8 times the depth of said grooves, said depth of said recessed portions being measured from the tips of said ridge portions, the pitch of said recessed portions is 0.25 to 1.0 mm, said pitch of said recessed portions being measured in the longitudinal direction of said ridge portions, and the width of said recessed portions in the tip portions of said ridge portions is 0.01 to 1.0 times the pitch of said recessed portions.

3. A vapor-condensing, heat transfer wall as set forth in claim 1, wherein the width of said grooves is 0.35 mm, the depth of said grooves is 0.9 mm, the thickness of said ridge portions is 0.35 mm, the depth of said recessed portions is 0.2 mm, as measured from the tips of said ridge portions, the pitch of said recessed portions is 0.5 mm as measured in the longitudinal direction of said ridge portions, and the width of said recessed portions in the tip portions of said ridge portions is 0.2 mm.

* * * * *